US008037613B2

(12) United States Patent
Everett, Jr. et al.

(10) Patent No.: US 8,037,613 B2
(45) Date of Patent: Oct. 18, 2011

(54) SHAVING HEAD FOR ROTARY SHAVER AND METHOD OF MANUFACTURING THE SAME

(75) Inventors: David W. Everett, Jr., Verona, WI (US); Maciei Murzynski, Verona, WI (US)

(73) Assignee: Rovcal, Inc., Madison, WI (US)

( * ) Notice: Subject to any disclaimer, the term of this patent is extended or adjusted under 35 U.S.C. 154(b) by 1439 days.

(21) Appl. No.: 10/932,523

(22) Filed: Sep. 2, 2004

(65) Prior Publication Data

US 2006/0042100 A1 Mar. 2, 2006

(51) Int. Cl.
*B26B 19/14* (2006.01)

(52) U.S. Cl. ..... 30/346.51; 30/43.6

(58) Field of Classification Search ..... 30/43.6, 30/43.9, 43.92, 346.51; 76/104.1
See application file for complete search history.

(56) References Cited

U.S. PATENT DOCUMENTS

| | | | | |
|---|---|---|---|---|
| 2,223,768 | A | 12/1940 | Martin | |
| 2,824,367 | A * | 2/1958 | Mcwilliams | 30/41.5 |
| 2,877,548 | A * | 3/1959 | Gerrit Starre | 30/346.51 |
| 3,064,348 | A | 11/1962 | Wahl | |
| 3,226,527 | A | 12/1965 | Harding | |
| 3,279,057 | A * | 10/1966 | Sanders | 30/43.3 |
| 3,281,937 | A * | 11/1966 | Driessen et. al. | 30/346.51 |
| 3,453,909 | A | 7/1969 | Yager | |
| 4,011,123 | A | 3/1977 | Buysman | |
| 4,105,493 | A | 8/1978 | Chauvy | |
| 4,124,437 | A | 11/1978 | Bond et al. | |
| 4,126,510 | A | 11/1978 | Moscony et al. | |
| 4,133,103 | A | 1/1979 | Beck | |
| 4,339,296 | A | 7/1982 | Gursky et al. | |
| 4,389,279 | A | 6/1983 | Weber et al. | |
| 4,393,586 | A * | 7/1983 | Hamashima et al. | 30/43.6 |
| 4,512,843 | A | 4/1985 | Miyazaki | |
| 4,635,360 | A * | 1/1987 | Tanahashi et al. | 30/34.2 |
| 4,707,923 | A * | 11/1987 | Tietjens | 30/346.51 |
| 5,023,986 | A | 6/1991 | Gero et al. | |
| 5,387,313 | A | 2/1995 | Thoms | |
| 5,628,921 | A | 5/1997 | Beckett | |
| 5,750,956 | A | 5/1998 | Barnes et al. | |
| 5,802,932 | A | 9/1998 | Vankov et al. | |
| 6,032,365 | A | 3/2000 | Hodges | |
| 6,053,332 | A | 4/2000 | Bakula | |
| 6,340,089 | B1 | 1/2002 | Bakula | |
| 6,515,253 | B1 | 2/2003 | Battaglia | |
| 6,515,256 | B1 | 2/2003 | Battaglia | |
| 2003/0070304 | A1 | 4/2003 | Curello | |
| 2003/0116543 | A1 | 6/2003 | Battaglia | |

FOREIGN PATENT DOCUMENTS

| | | |
|---|---|---|
| EP | 0 124 171 | * 11/1984 |
| JP | 53-146855 | * 12/1978 |
| JP | 64 68563 | * 3/1989 |

* cited by examiner

*Primary Examiner* — Hwei C Payer
(74) *Attorney, Agent, or Firm* — Armstrong Teasdale LLP

(57) ABSTRACT

A rotary shaving head having a one-piece cup-shaped metal body including a comb portion. A plurality of openings in the comb portion are defined by opposed sidewalls, the intersection of at least one sidewall of at least one of the openings with an inner surface of the comb portion defining a cutting edge having a positive rake angle. A rotary shaving head manufacturing method includes the steps of etching a set of openings corresponding to a shaving head blank into an elongate flat metal strip, forming the blank into a cup-shaped unfinished shaving head, and removing material from the inner surface of the comb portion of the unfinished shaving head.

11 Claims, 14 Drawing Sheets

SHAVING HEAD FOR ROTARY SHAVER AND METHOD OF MANUFACTURING THE SAME

FIELD OF INVENTION

The present invention relates generally to rotary electric shavers, and more particularly to shaving heads for rotary type shavers wherein the shaving head has openings that form positive rake angle cutting edges, and to a method of manufacturing such shaving heads.

BACKGROUND OF THE INVENTION

Electric shavers are commonly used to shave facial and body hair. Many people prefer electric shavers to razors because the cutting blades of electric shavers do not contact the skin. There is a belief that the lack of blade contact with the skin reduces the risk of nicks, cuts and other skin irritations. One conventional electric shaver is commonly referred to as a rotary shaver, wherein a rotary cutter is disposed within and rotates relative to a circular shaving head. For example, with reference to the typical rotary electric shaver shown in FIGS. 1 and 2, the use of a rotary shaver 11 involves rubbing one or more shaving heads 13 (commonly two or three per shaver) over the surface of the skin 25. As shown in FIG. 3, hairs 23 (e.g., whiskers) enter openings 15 in the shaving heads 13. The blades 19 of a rotary cutter 17 abut against and slide relative to the inner surface (or under surface, which is also sometimes referred to as a track surface) 21 (FIG. 3) of each of the heads 13. The intersection of the sidewalls 27 that form the shaving head openings 15 and the inner surface 21 of the shaving head form cutting edges 29. The shearing action between the blades 19 of the rotary cutter 17 and the cutting edges 29 shears hairs 23 that extend through the openings 15 without requiring the cutting blades 19 or cutting edges 29 to contact the skin 25.

Manufacture of conventional rotary shaving heads 13 typically involves forming a large batch of shaving heads in series from a continuous strip of metal using a die system (e.g., a progressive die system). After the heads 13 are formed, slot-shaped openings 15, as shown in FIG. 4 for example, are cut in each of the heads 13 with a saw. This time consuming and inefficient process substantially increases manufacturing costs. Use of the saw to make the openings 15 also limits the possible geometries of the openings. First, the cutting edges 29 formed by sawed openings are less than ideal. FIG. 3 is a cross section of a typical sawed opening 15. A hair 23 that has entered the opening is about to be sheared between one of the cutting edges 29 and one of the blades 19 of a rotary cutter 17. Because the opening 15 has been cut with a saw, the sidewalls 27 of the opening are substantially planar. Further, the sidewalls 27 are substantially perpendicular to the inner surface 21 of the shaving head, which means the cutting edge 29 has virtually no rake angle (i.e., the sidewall of the opening intersects the inner surface at a substantially perpendicular orientation). The shearing action produced by the rotary cutter 17 would be improved if the cutting edge 29 had a positive rake angle (i.e., if the sidewall of the opening and the inner surface 21 of the shaving head 13 formed an acute angle at the cutting edge) because the zero rake angle cutting edge 29 has a large contact area with the hair and is therefore subjected to relatively large forces as the hair is sheared. The result is that the cutting edge 29 wears out after a relatively short time, thereby necessitating frequent replacement of worn out shaving heads. Unfortunately, conventional technology makes manufacture of rotary shaving heads having positive rake angle cutting edges uneconomical.

Referring to FIG. 4, a conventional sawed opening 15 is elongate and rectangular in plan view. That is, the opening 15 extends in a linear path along its length. Non-linear openings (e.g., a curved or serpentine slot shape) can more readily facilitate the entry of hairs, particularly longer hairs which are often at least slightly curved, into the openings. To this end, U.S. Pat. No. 6,515,253 (Battaglia) discloses a method of manufacturing rotary shaving heads having slightly curved slots and other openings having non-rectangular geometries by using a laser to cut the openings in shaving head blanks (either before they are formed by a progressive die system or between stages of a progressive die system). Using a laser to make the slots as disclosed in the '253 patent, however, splatters melted metal debris onto the back of the laser-etched blanks. The debris prevents the blanks from lying flat on the forming equipment, increases the probability for misfeed of the blanks through the forming equipment, and increases the probability that the blanks will get stuck in the forming equipment. Thus, after laser etching the blanks need to be processed to remove the debris, thereby adding to the time and expense of the manufacturing process. Furthermore, the laser-etched openings are similar to the sawed openings in that the laser cuts straight through the metal perpendicular to the inner surface of the shaving head, which means the cutting edges formed by laser-etched openings have virtually no rake angle. Thus, while laser-etched openings may extend along a non-linear path, the curved openings produced by the laser still do not produce a cutting edge having a positive rake angle.

In contrast, perforated foil and microscreen shaver parts having more suitably sharp cutting edges have been manufactured by chemical (or electrochemical) etching processes. Whereas openings formed with lasers and saws have sidewalls that pass substantially straight through the substrate, the reaction kinetics of chemical etching processes can be used to form openings having arcuate sidewalls. These arcuate sidewalls can be used to make finely honed cutting edges having positive rake angles. For example, U.S. Pat. No. 5,802,932 (Vankov, et al.) teaches that sharp teeth having positive rake angles can be etched into a flat elongate cutter used for a reciprocating beard trimmer. Etched shaver parts are manufactured as an array of parts on a single panel (i.e., a piece of sheet metal). The entire array is etched at the same time by immersing the panel in a tank (or sequence of tanks) containing the etching chemicals. However, the chemical etching of foils is typically conducted with the foil in a relatively thin condition, and there is no subsequent forming (e.g., permanent deforming) of the foil. Any forming of the foil after etching is likely to result in structural failure thereof. Such a process is therefore not compatible with the making of rotary shaver shaving heads, which must be formed into its cup-shaped configuration.

SUMMARY OF THE INVENTION

A shaving head for a rotary shaver of the present invention has a one-piece, generally cup-shaped metal body having an internal cavity for receiving a rotary cutter. A comb portion has an outer surface for contacting skin to be shaved and an inner surface in part defining the internal cavity. The comb portion also has a plurality of openings therein. The openings are defined by opposed sidewalls. The intersection of at least one sidewall of at least one of the openings with the inner surface of the comb portion of the body defines a cutting edge having a positive rake angle.

A method of manufacturing a shaving head for a rotary shaver includes the step of feeding an elongate, generally flat metal strip to a chemical etching station. A set of openings corresponding to a shaving head blank to be formed from the metal strip is chemically etched into the metal strip at the etching station. The metal strip is fed to an automated forming station after it has been etched. The blank is formed at the automated forming station to form a generally cup-shaped unfinished shaving head wherein at least some of the chemically etched openings define a comb portion of the shaving head having an outer surface and an inner surface. The unfinished shaving head is removed from the metal strip. Material is removed from the inner surface of the comb portion of the unfinished shaving head.

BRIEF DESCRIPTION OF THE DRAWINGS

Corresponding reference characters indicate corresponding parts throughout the drawings.

DETAILED DESCRIPTION

Figure 1:
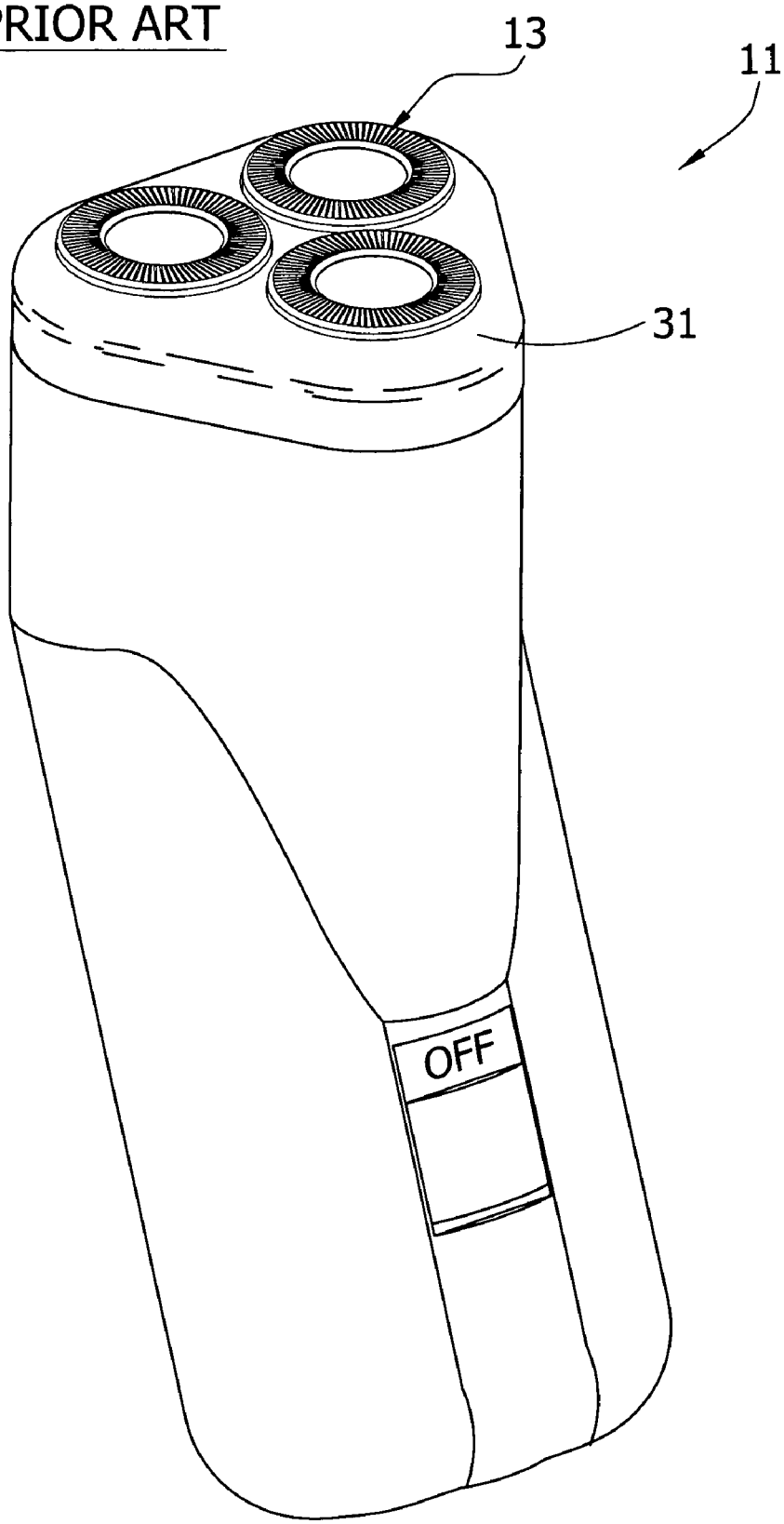
FIG. 1 PRIOR ART
FIG. 1 is a perspective view of a prior art rotary electric shaver having three shaving heads.
Figure 2:
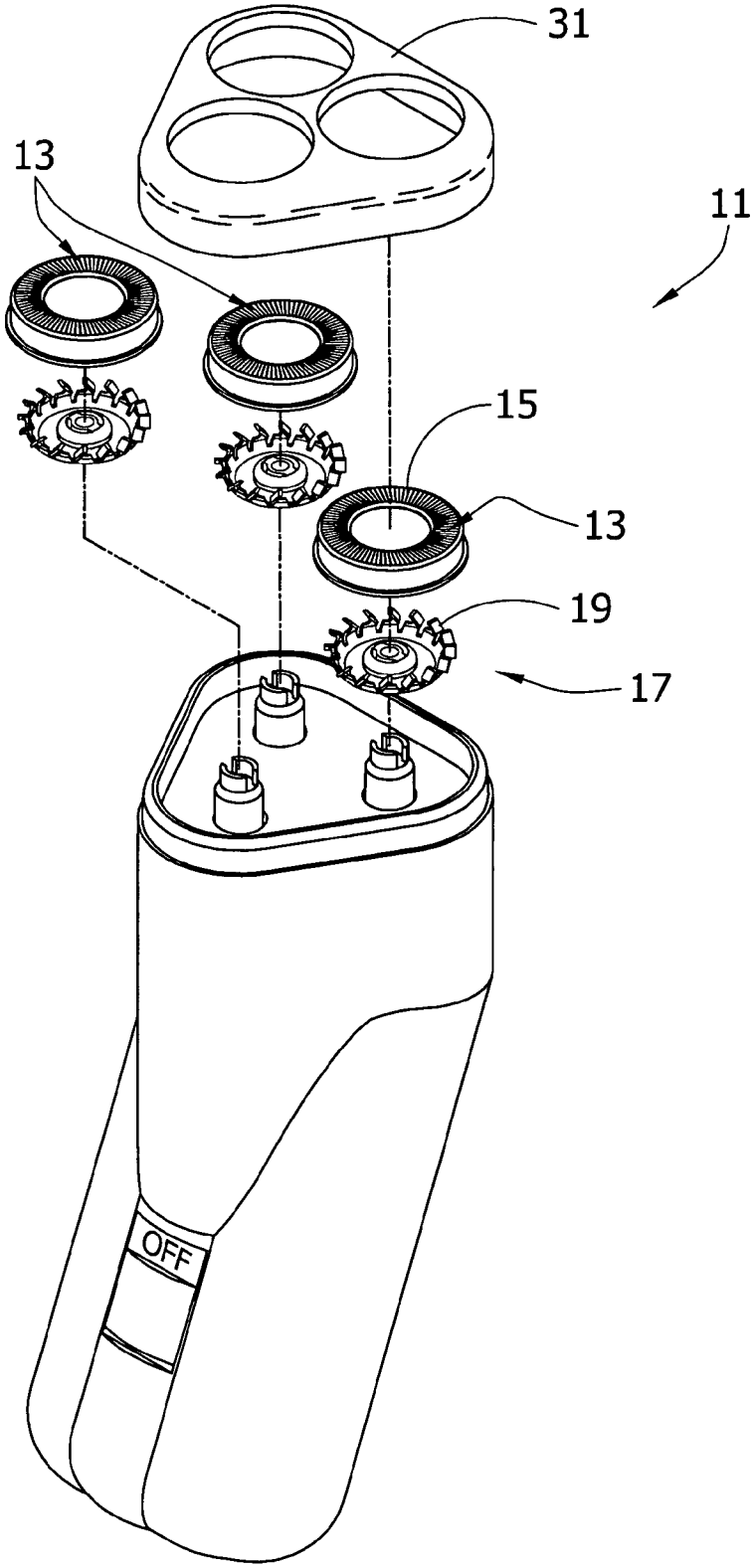
FIG. 2 PRIOR ART
FIG. 2 is another perspective view of the shaver shown in FIG. 1 in which some parts have been exploded to show internal construction.
Figure 3:
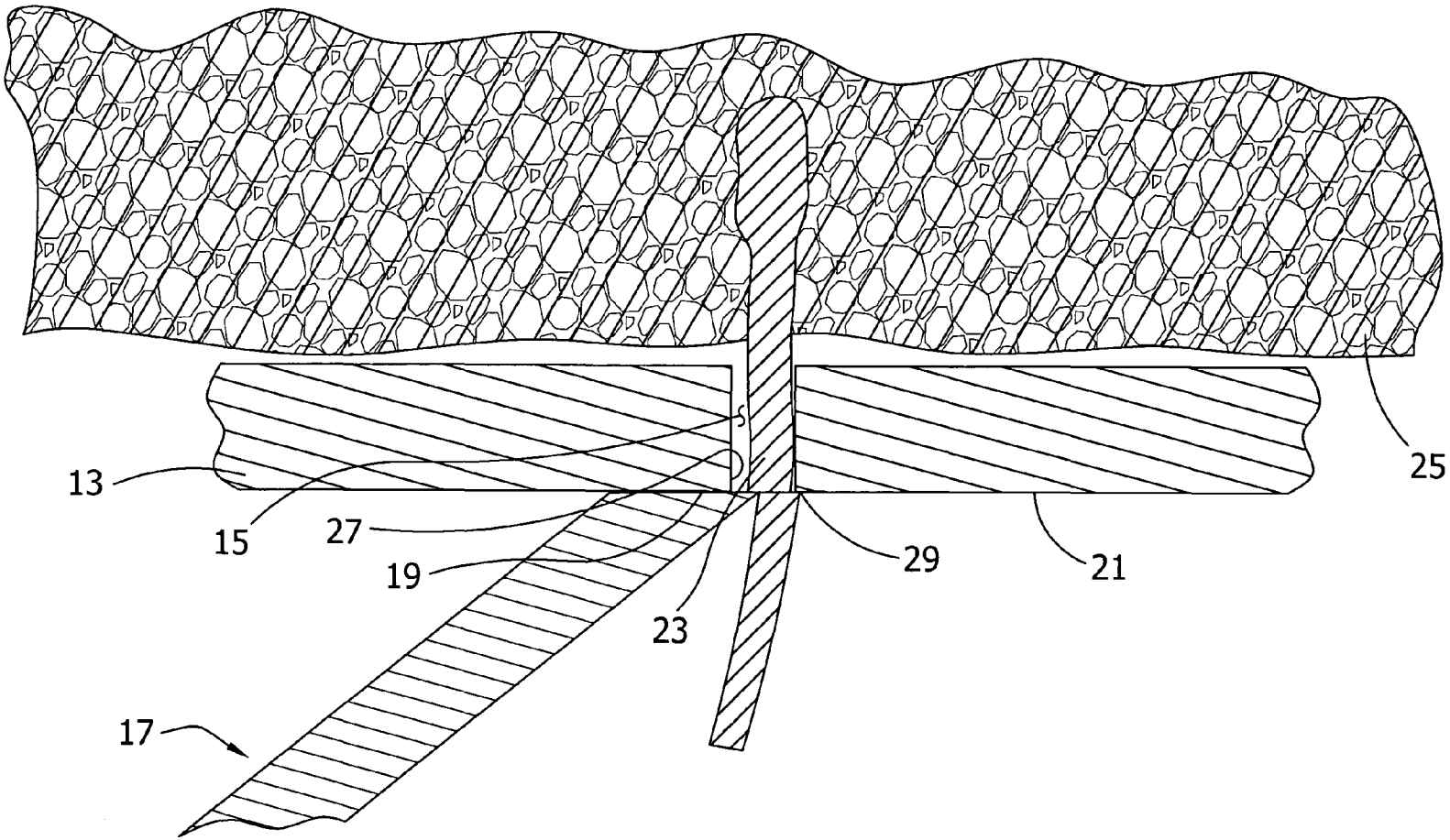
FIG. 3 PRIOR ART
FIG. 3 is a schematic diagram of a hair being cut by the rotary shaver of FIG. 1.
Figure 4:
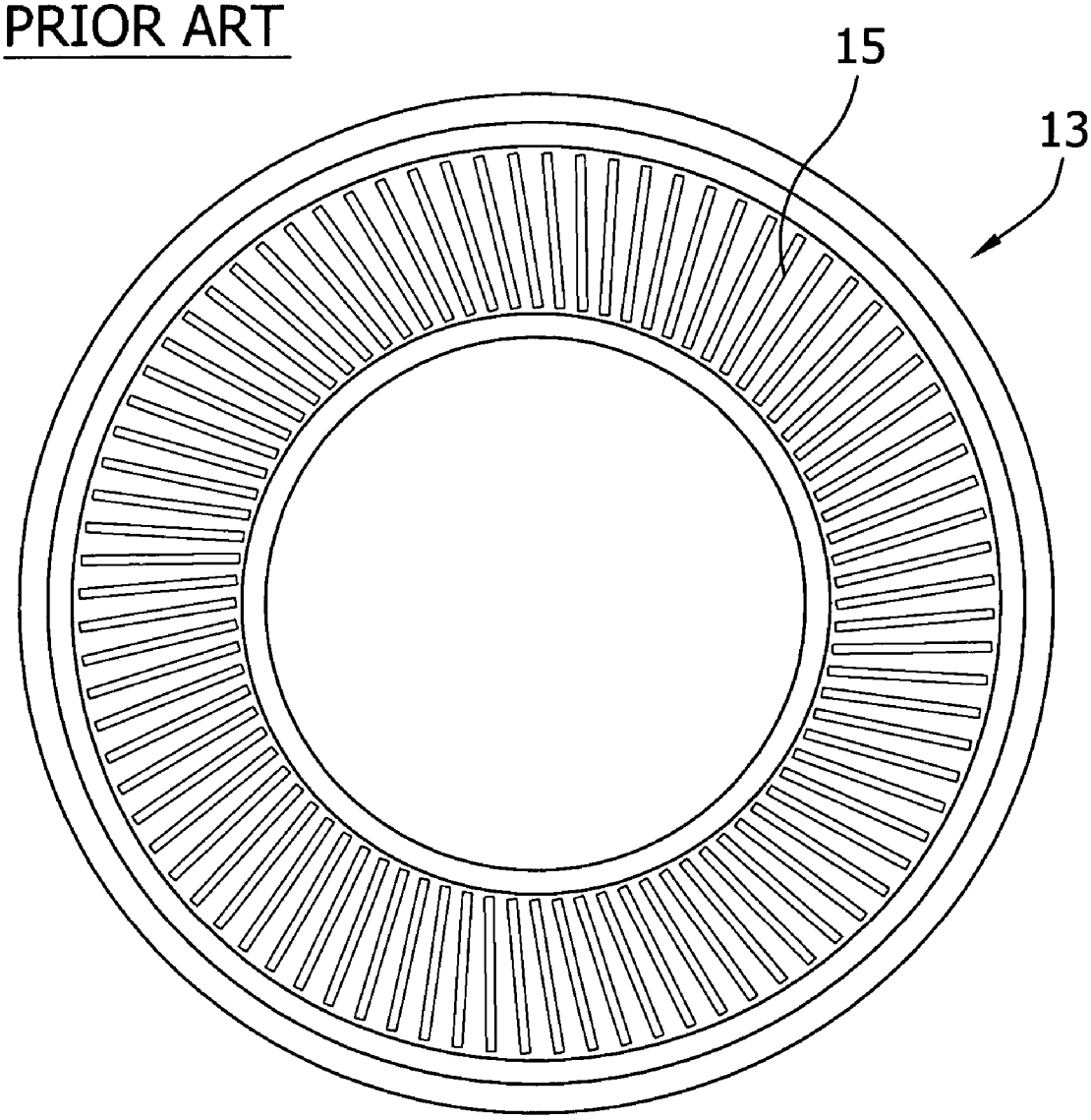
FIG. 4 PRIOR ART
FIG. 4 is a plan view of a prior art rotary shaving head showing openings cut into the shaving head using a saw.
Figure 5:
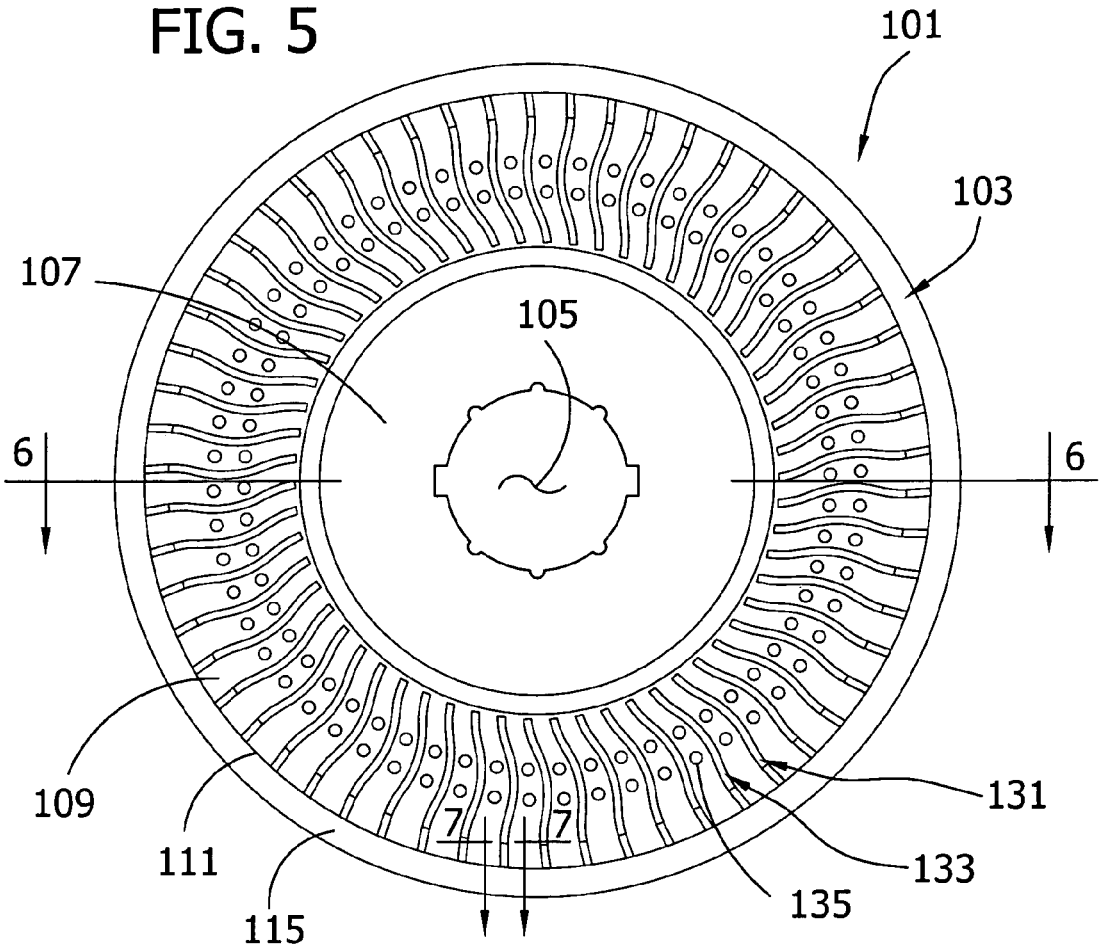
FIG. 5 is a plan view of one embodiment of a shaving head of the present invention for use with a rotary electric shaver.
Figure 6:
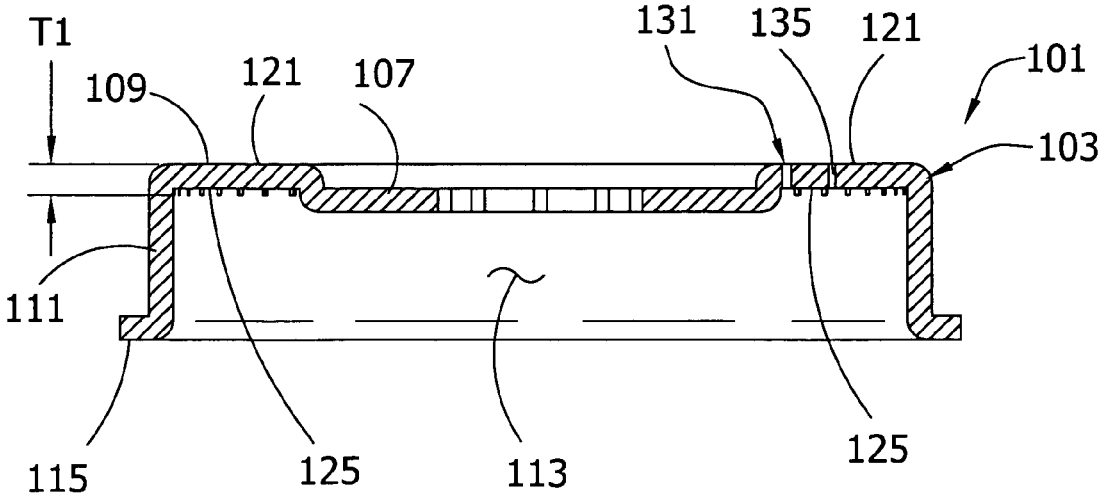
FIG. 6 is a cross section of the shaving head shown in FIG. 5 taken through the plane of line 6-6 of FIG. 5.

Referring now to the drawings and in particular to FIGS. 5 & 6, a shaving head according to one embodiment of the present invention for use with a rotary shaver is generally designated 101. The shaving head 101 is suitable for use with a rotary shaver such as the shaver 11 shown in FIGS. 1 & 2. The shaving head 101 can be provided as one of the original shaving heads of a rotary shaver or provided as a replacement head for a rotary shaver. The shaving head 101 can also be provided as a replacement head for a rotary shaver that was originally equipped with conventional shaving heads.

The shaving head 101 comprises a single-piece, generally cup-shaped metal body 103. An opening 105 has been provided at the center of the body 103 for receiving a conventional guide post insert (not shown) that helps keep a rotary cutter (not shown, but similar to the rotary cutter 17 shown in FIG. 2) centered with respect to the shaving head 101 and provides structural support for the shaving head 101. A flat annular insert retaining portion 107 of the body surrounds the opening 105. An embossed, circular comb portion 109 of the metal body 103 surrounds the insert retaining portion 107. The cup-shaped metal body 103 has been formed to have an annular sidewall 111 depending from the peripheral edge of the comb portion 109. The sidewall 111 extends substantially perpendicular to the comb portion 109 such that the sidewall and comb portion together define an internal cavity 113 for housing the rotary cutter. The metal body 103 has also been formed to have an annular retaining flange portion 115 extending outward from the distal edge of the sidewall 111.

As described below, an outer (e.g., skin facing) surface 121 of the comb portion 109 of the shaving head 101 is rubbed against the skin during shaving and while blades of the rotary cutter slide on an inner (cutter facing) surface 125 (sometimes referred to as a track surface) of the comb portion. As such, the thickness of the comb portion 109 of the shaving head 101 generally defines the closeness of the shave. It is therefore desirable for the comb portion 109 of the metal body 103 to be relatively thin because the blades of the rotary cutter cannot get close enough to the skin to provide a close shave if the comb portion is too thick. In one embodiment, the thickness T1 of the comb portion is suitably in the range of about 0.0025 inches to about 0.0055 inches, and more suitably about 0.003 inches. The dimensions of the insert retaining portion, comb, flange, and sidewall of the shaving head 101 may vary from one rotary shaver design to the next and one having ordinary skill in the art could optimize these parts to suit any particular rotary shaver design.

A set of openings 131 are formed in, and are more suitably chemically etched in, at least the comb portion 109 to extend from the outer surface 121 through to the inner surface 125 through the comb portion 109 to permit hair to pass through the openings into the interior cavity of the shaving head for cutting by the rotary cutter. As used herein the terms "chemically etched" and "chemical etching" also include electrochemically etched and electrochemical etching, respectively. Referring to FIG. 5, some of the openings 131 of the illustrated embodiment are elongate S-shaped or serpentine slots 133. Others are circular holes 135. Regardless of the plan view geometry of the openings 131, the openings are suitably defined by arcuate sidewalls 137 which create cutting edges having a positive rake angle as discussed further below.

Figure 7:
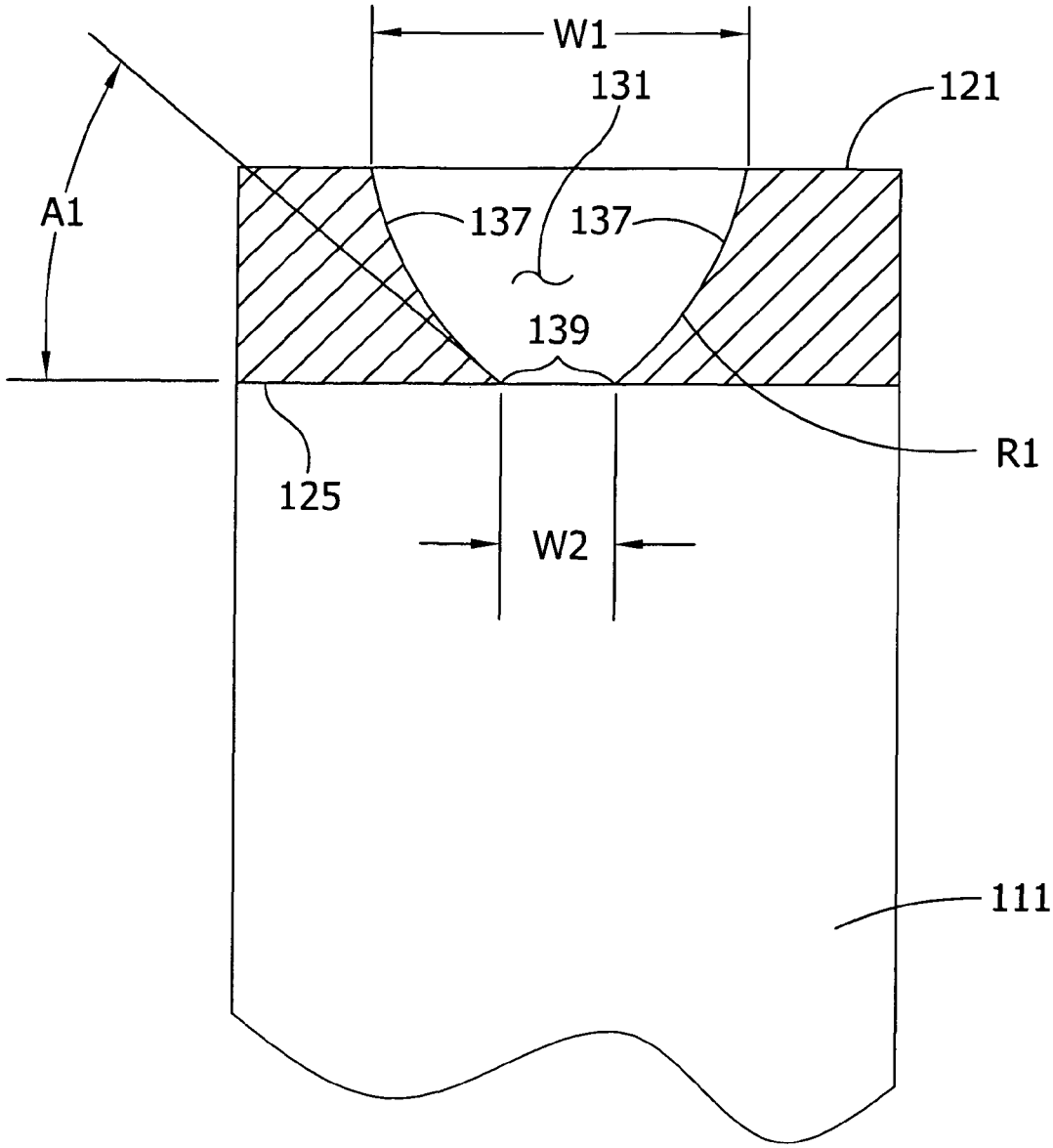
FIG. 7 is an enlarged cross section of a portion of the shaving head shown in FIG. 5 taken through the plane of line 7-7 of FIG. 5.

Referring to FIG. 7, which shows one of the S-shaped slots 133 in cross section, the opening 131 is at least partially defined by arcuate sidewalls 137, which are indicative of a chemical etching process. The relevant curvature of an openings' sidewall 137 is determined with reference to a cross section of the opening 131 taken through a cutting plane that contains the line of action of the blades of a rotary cutter at the opening and that is generally perpendicular to the inner surface 125 (e.g., FIG. 7) of the shaving head 101. The sidewalls 137 of the illustrated opening 131 intersect the outer surface 121 of the shaving head 101 nearly perpendicularly, but the sidewalls 137 gradually and continuously curve toward each other as they extend away from the outer surface 121 (e.g., toward the inner surface 125). Thus, the opening 131 is wider at the outer surface 121 than at the inner surface 125. In the illustrated embodiment, for example, the width W1 of the opening 131 at the outer surface 121 is suitably between about 0.012 and about 0.015 inches and the width W2 of the opening 131 at the inner surface 125 is suitably in the range of about 0.010 to about 0.011 inches. Hairs are less likely to protrude into the shaving head if the width is significantly less than 0.010 inches (i.e., less than a few times the width of a hair). If the width significantly exceeds 0.011 inches on the other hand, skin tends to be pulled into the opening and abraded by the rotary cutter, thereby causing painful irritation. It is understood, however, that these widths W1, W2 may vary without departing from the scope of the invention.

The sidewalls 137 of the opening 131 each intersect the inner surface 125 of the shaving head 101 at an acute angle A1 (broadly referred to herein as a rake angle) because of their curvatures. Consequently, cutting edges 139 having a positive rake angle are formed by the intersection of the opening sidewalls 137 and the shaving head inner surface 125. As an example, in one embodiment the rake angle A1 formed by the intersection of the opening sidewall 137 and the inner surface 125 of the shaving head 101 is suitably between about 45 and about 65 degrees, more suitably between about 50 and about 60 degrees, and even more suitably about 55 degrees. If the angle A1 is significantly larger than 65 degrees, the cutting edge 139 is more akin to a zero rake angle cutting edge in that it would be subjected to relatively larger stresses and unnecessary wear from the shearing action. Durability of the cutting edges 139 will also suffer if the angle A1 is significantly less than 45 degrees because the thinness of the cutting edges makes them too flimsy, which offsets the benefits of reducing the stresses on the cutting edges.

The precise shape of the sidewalls 137 of the openings 131 is dictated by the reaction kinetics and/or rate limiting mass transfer effects for the chemical etching process and subsequent processing, which can be varied to produce a variety of differently shaped sidewalls of the openings. Referring to the slot 133 shown in FIG. 7, for example, the curvature of the sidewalls 137 generally adjacent the cutting edges 139 substantially conforms with a radius of curvature R1 in the range of about 0.004 and about 0.007 inches, more suitably in the range of about 0.005 and 0.006. Typically, the curvature of the sidewalls 137 is not a true radius because lateral extension of the openings 131 due to the etchant's natural tendency to undercut the mask during the etching process influences the curvature of the sidewalls 137, especially portions of the sidewalls 137 that are adjacent the outer surface 121 of the comb portion 109. The lateral extension effect has the least influence on the curvature of the sidewalls 137 adjacent the inner surface 125, which is where the curvature is most relevant because the characteristics of the cutting edges 139 are determined by the curvature of the sidewalls 137 as they intersect the inner surface 125. Thus, the radius of curvature of the sidewall 137 adjacent the cutting edge 139 is a useful metric for describing the impact of the curvature of the sidewalls on the characteristics of the cutting edge.

Although the opening 131 shown in FIG. 7 is an elongate, generally S-shaped or serpentine slot 133, it is understood that chemically etched openings may have virtually any plan view geometry and will be formed to have opening sidewalls 137 that are generally congruent with the sidewalls shown in FIG. 7. More particularly, openings 131 having substantially circular, straight slot, curved slot, or irregular plan view geometries can be chemically etched to have sidewalls 137 that gradually and continuously curve toward each other as the sidewalls extend away from the outer surface 121. Those openings can also be chemically etched so that the sidewalls intersect the inner surface 125 at the desired angle, e.g., in the range of about 45 to about 65 degrees as described previously. Furthermore, those openings 131 can be chemically etched so that the opening sidewalls 137 have a curvature adjacent the cutting edge 139 that substantially conforms to the desired radius of curvature, e.g., in the range of about 0.004 to about 0.007 inches.

In the illustrated embodiment, the sidewalls 137 of the openings 131 are generally symmetric with each other as a consequence of the chemical etching process. However, it is understood that the sidewalls could be asymmetric due to modifications to the etching process, subsequent processing, etc. Furthermore, most rotary shavers rotate the rotary cutter in only one direction, which means that one of the cutting edges formed by the sidewalls 137 of each opening 131 is not involved in shearing hairs. It is understood that the particular curvature of a sidewall is irrelevant if the cutting edge formed by the intersection of that sidewall with the inner surface is not used to shear hairs. Those skilled in the art will recognize from the foregoing that the geometries of the openings and the shape of the sidewalls may therefore vary widely without departing from the scope of the invention.

Figure 8:
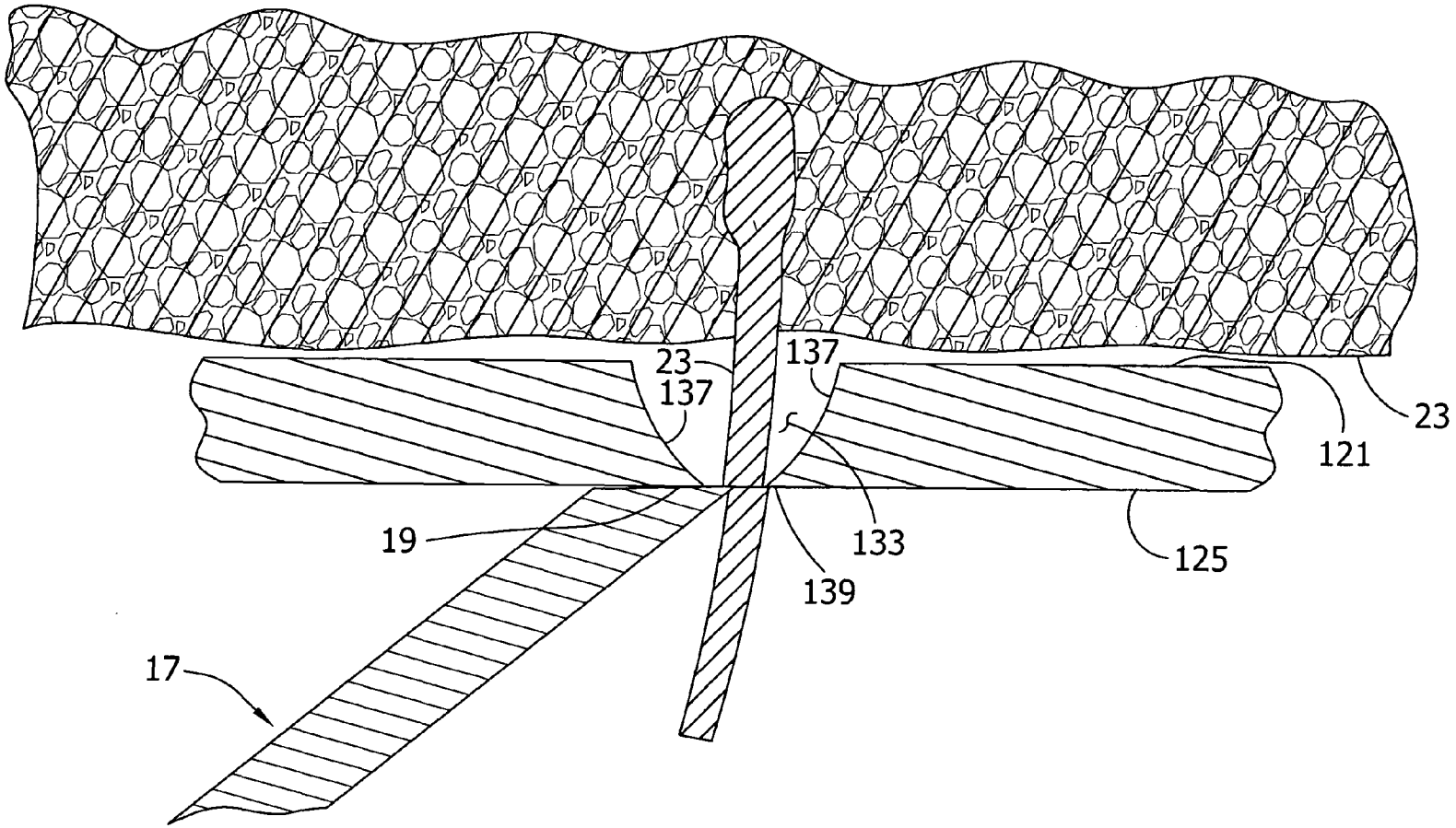
FIG. 8 is a schematic diagram of a hair being cut by a rotary shaver incorporating the shaving head of FIG. 5.

In operation, a conventional clip 31 (shown in FIG. 1) or other retaining mechanism holds the shaving head 101 by its retaining flange 115 to fasten the shaving head in a position in which the rotary cutter (e.g., rotary cutter 17 of the shaver of FIG. 1) is received in the cavity 113. As shown in FIG. 8, the blades 19 of the rotary cutter 17 make contact with and slide on the inner surface 125 of the comb portion 109 of the shaving head as an electric motor or other drive (not shown) rotates the rotary cutter. The outer surface 121 of the comb portion 109 is moved over the skin 25 to be shaved. The non-linear geometry of the openings 131 in the comb portion 109 promotes more hairs to extend out from the skin through the openings into the internal cavity 113 of the shaving head. Hairs 23 protruding through the openings 131 are sheared between the blades 19 of the rotary cutter 17 and the positive rake angle cutting edges 139 of the comb portion 109 of the shaving head 101. Because of the design of the positive rake angle cutting edges 139 the hairs 23 are sheared cleanly with less stress on the cutting edges 139 and the blades 19.

Manufacture of Shaving Heads

Figure 9:
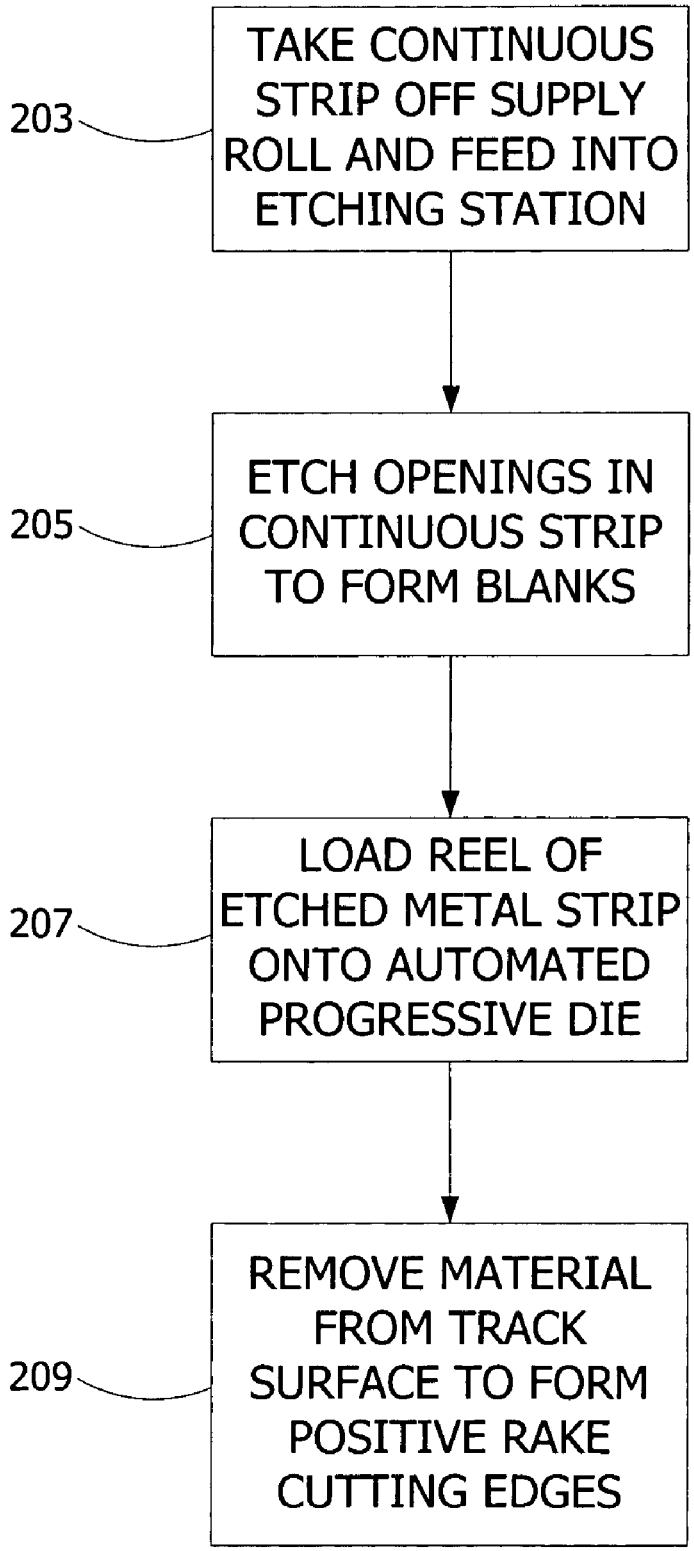
FIG. 9 is a work flow diagram of one embodiment of a manufacturing process of the present invention.

FIG. 9 is a work-flow diagram providing an overview of one embodiment of a method of the present invention for high-volume manufacture of chemically etched shaving heads such as the shaving head 101 described above. In general, the first step 203 comprises feeding a long, generally flat strip of metal from a supply roll (e.g., a coil) to a continuous chemical etching station. As the strip moves through the etching station at step 205, discrete sets of openings are chemically etched into the strip to make a series of shaving head blanks, one after another in the direction of movement of the strip. Each set of openings includes openings that correspond to the openings 131 in the comb portion of the finished shaving head 101. After the openings have been etched into the strip, at step 207 the strip is fed into a forming system that forms the shaving head blanks into cup-shaped shaving heads and severs the formed shaving heads from the strip. Material is then removed from the inner surface 125 of the comb portion 109 at step 209 with a grinder to produce positive rake angle cutting edges 139 and to form the desired thickness of the comb portion. The method will be described in further detail below.

Figure 10:
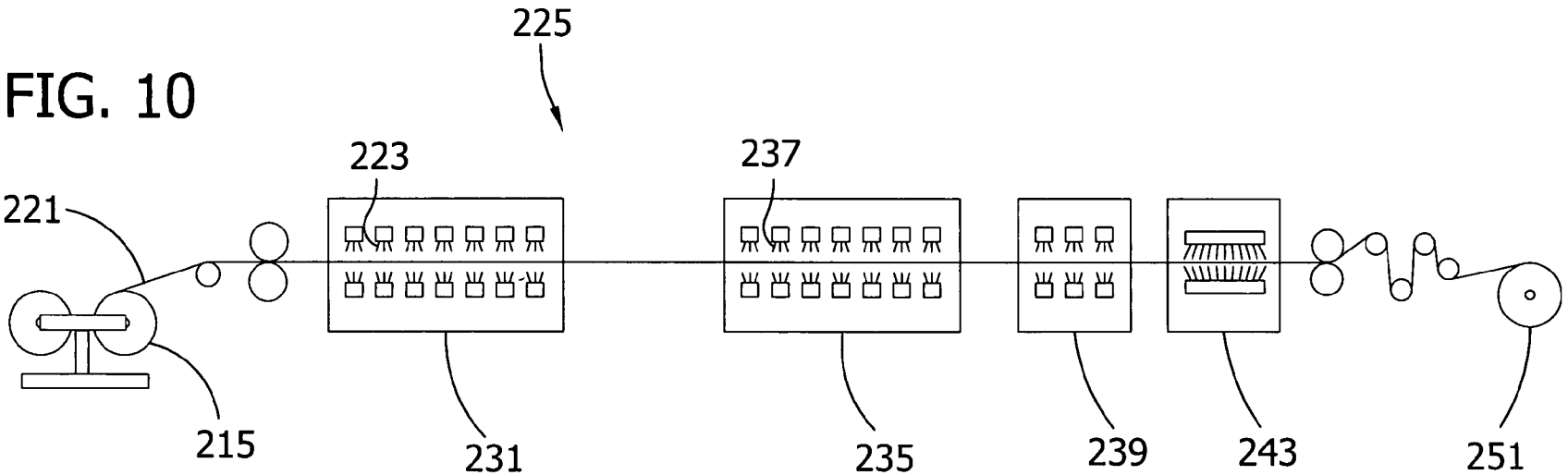
FIG. 10 is a schematic diagram of a reel-to-reel etching process used in one embodiment of the present invention for making a shaving head for a rotary shaver.

Referring now to FIG. 10, a supply roll 215 has a long, flat (e.g., planar or otherwise unformed) metal strip 221 wound on it, e.g., in the manner of coil. As an example, the metal strip 221 may suitably comprise stainless steel. However, it is understood that other suitable metals may be used to make the shaving head 101 and remain within the scope of this invention. A width W3 (FIG. 12) of the strip 221 can vary, but is preferably somewhat wider than the diameter of a shaving head blank (e.g., before forming) so that there is a margin 223 between the blank and the edge of the strip 221. In one suitable embodiment, the width W3 of the strip 221 is between about 1.0 inch and about 1.5 inches. A thickness T2 (FIG. 13) of the metal strip 221 is greater than the desired end thickness of the comb portion 109 of the finished shaving head 101. This provides structural integrity to the shaving head blank during subsequent forming. As an example, the thickness T2 (FIG. 13) of the strip 221 may suitably be between about 0.009 and about 0.012 inches. If the strip 221 starts out significantly thicker than 0.012 inches, the chemical etching process may cause too much lateral extension of the openings. On the other hand, if the strip 221 starts out thinner than 0.009 inches the strip may be more susceptible to damage and the etched blanks may be too fragile for further forming. In a particularly suitable embodiment, the initial thickness T2 of the strip 221 is about 0.012 inches. The strip 221 can be any length, but it is desirable for the strip to be long enough that a substantial supply of unetched metal strip remains on the supply roll 215 after the etching station has completed etching the first of a long series of shaving head blanks into a leading portion of the strip.

The leading edge of the strip 221 from the supply roll 215 is fed through the etching station. Systems for chemically etching long continuous metal strips are known to those skilled in the art and will not be described in detail herein other that to the extent necessary to disclose the present invention. For example, various systems for chemically etching continuous metal strips are provided in the following U.S. Patents, which are hereby incorporated herein by reference: U.S. Pat. No. 5,628,921 (issued to Beckett May 13, 1997); U.S. Pat. No. 5,387,313 (issued to Thoms, Feb. 7, 1995); U.S. Pat. No. 4,512,843 (issued to Miyazaki Apr. 23, 1985); U.S. Pat. No. 4,389,279 (issued to Weber, et al., Jun. 21, 1983); U.S. Pat. No. 4,339,296 (issued to Gursky, et al., Jul. 13, 1982); U.S. Pat. No. 4,126,510 (issued to Moscony, et al., Nov. 21, 1978); U.S. Pat. No. 4,124,437 (issued to Bond, et al., Nov. 7, 1978); and U.S. Pat. No. 4,011,123 (issued to Buysman Mar. 8, 1977).

In general, etching processes require the piece of metal that is to be etched to be cleaned first. For example, chemical solvents can be used to remove dirt, rust, debris and oil residues from the surface of the metal. The clean dry metal is then coated on both sides with a thin photoresist, such as a UV light sensitive polymer. The photoresist can be applied as liquid by drip coating, but it is more commonly applied as a dry film by hot roller lamination. Selected areas of the photoresist are exposed to light through a tool having openings corresponding to the etching pattern (or a negative thereof) while other areas of the photoresist are shielded from the light by the tool. The areas of the photoresist exposed to the light harden and the areas shielded from the light remain soft (or vice-versa). A stripping process is used to strip soft areas of the photoresist away to expose bare metal. However, the hardened areas of photoresist are sufficiently resilient to the stripping process to substantially avoid being stripped from the metal. The piece is then exposed to an etchant, which attacks the bare metal while the hardened areas of the photoresist shield the underlying metal from the etchant. After the etching is complete, the etchant is rinsed away and the remaining photoresist is stripped from the etched metal.

FIG. 10 is a schematic diagram of a suitable etching station 225 that can be used to etch shaving head blanks in the metal strip 221. The strip 221 has already been prepared before it was rolled on the supply roll by conventional application of patterned masks (e.g., photoresist masks) to the outer (e.g., skin facing) and inner (e.g., cutter facing) sides of the strip. The strip is unwound from the supply roll and fed into an etching chamber 231, where an etchant 233 (e.g., a liquid or gas that corrodes exposed metal but not the mask) is sprayed onto both sides of the strip. In another embodiment, the supply roll may be a generally bare metal strip which is first fed through a continuous masking system (not shown) upstream of the etching chamber 231. As the strip 221 moves through the etching chamber 231, discrete sets of openings 227 (seen best in FIG. 12) are etched through the strip, one set after another (or multiple sets after multiple sets) in the direction of movement of the strip through the etching chamber, to create a series of shaving head blanks 229 from the metal strip. Thus, after the first blank is etched in the leading part of the strip 221, the etching station continues to etch additional blanks into the following parts of the strip to create a series of spaced apart blanks in the strip.

Figure 12:
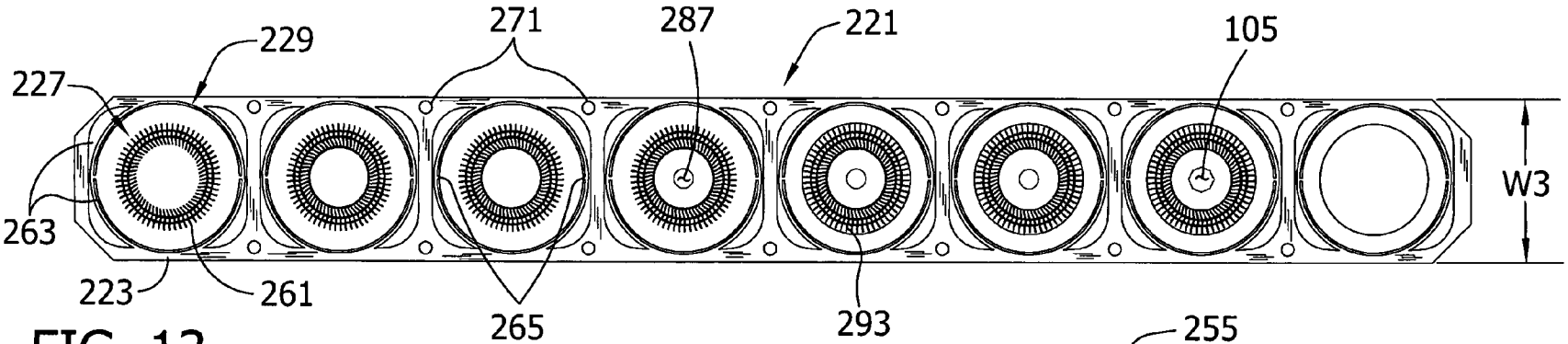
FIGS. 12-13 are schematic diagrams showing a forming sequence suitable for forming a continuous strip of chemically etched shaving head blanks into shaving heads on a progressive die system.

FIG. 12 shows a portion of the strip 221 after a series of identical shaving head blanks 229 have been etched thereon. The sets of openings 227 comprise openings 261 corresponding to the openings 131 in the comb portion 109 of the finished shaving head 101. The openings 227 also comprise blank isolating openings 263 that partially sever the shaving head blanks 229 from the strip 221. The blanks 229 thus remain connected to the strip 221 by two small connecting tabs 265. The purpose of the blank isolating openings 263 is to insulate the blanks 229 from the rest of the strip 221 as the blanks are subsequently formed into the cup-shaped shaving heads so that stresses from the forming process do not deform the edge margins of the strip 221. The blank isolating openings 263 also limit flow of metal in the forming process that would otherwise distort the shape of the openings 261 through the comb portion 109 during forming. The sets of openings 227 further comprise registration holes 271 (e.g., two holes per set) for centering the blanks 229 on the dies used to form the blanks into the unfinished shaving heads 257.

Figure 15:
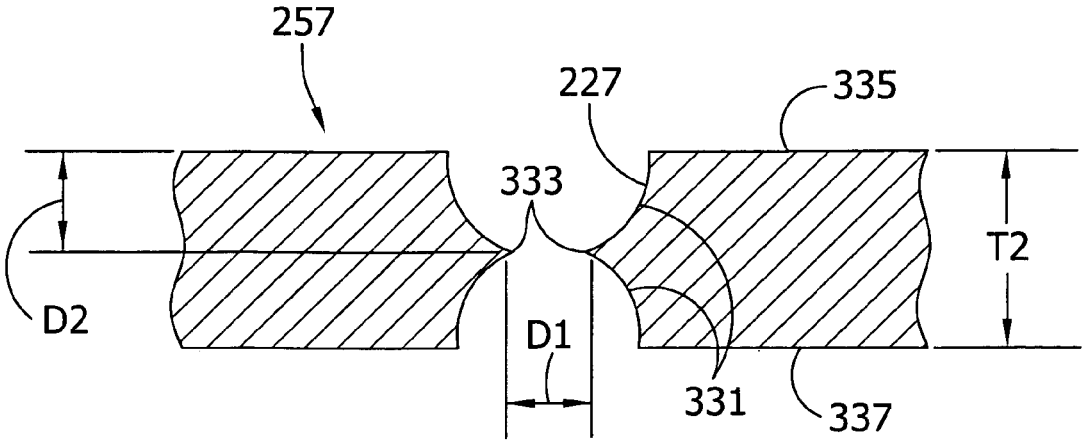
FIG. 15 is an enlarged cross section of a portion of the shaving head shown in FIG. 14 taken through the plane of line 15-15 of FIG. 14 showing the cross sectional shape of an opening before grinding of the shaving head.

In a particularly suitable embodiment, the both sides of the metal strip are etched to form the openings 227 that correspond to the openings 131 in the comb portion 109 of the finished shaving head 101. With particular reference to FIG. 15, etching both sides of the metal strip to form the openings 227 in this manner results in a pair of pits 331 being etched into the opposite sides of the metal strip. By continuing to expose the strip 221 to the etchant, the pits 331 are gradually enlarged until they eventually merge to form the opening 227. A pair of ridges 333 are formed where the pits 331 intersect. By continuing to expose the metal strip 221 to the etchant, the opening gradually widens and the distance D1 between the ridges 331 gradually increases. The etching is stopped before the distance D1 between the ridges exceeds the desired width of the opening 227. The distance D1 can also be less than the thickness T2 of the metal strip 221. As an example, in one embodiment the distance D1 between the ridges 333 may suitably be about 0.0095 inches. A distance D2 between the ridges 333 and the inner (skin facing) side of the strip 221 is between about 0.006 and about 0.0085 inches. This distance D2 can be varied by exposing the one side 335 of the strip 221 to the etchant for a longer period than the other side 337 or by providing a larger opening through the mask on the skin facing side 335 than on the cutter facing side 337. Some continuous chemical etching systems etch material at a faster rate from the bottom of the strip than from the top because the etchant readily drips off the bottom of the strip which allows fresh etchant to more readily access the bare metal. Thus, the distance D2 may also be affected by natural differences in etching rates from one side of the strip compared to the other. Positive rake angle cutting edges could also be formed by etching only the skin facing side 335 of the comb portion to form pits and then removing material from the unetched cutter facing side 337 in the subsequent grinding operation to convert the pits to openings having positive rake cutting edges without departing from the scope of this invention.

After the strip 221 passes out of the etching chamber 231, it is fed to a stripping chamber 235, where a chemical stripper 237 is sprayed onto the metal to remove the mask. After the strip moves out of the stripping chamber 235 it is fed sequentially through a rinsing chamber 239 and a drying chamber 243. After it has been etched, the strip 221 is rewound on a storage roll 251 for transport to a forming station. It is understood that the strip 221 may be fed directly from the etching station 225 to the forming station (e.g., without rewinding) and remain within the scope of this invention.

Figure 11:
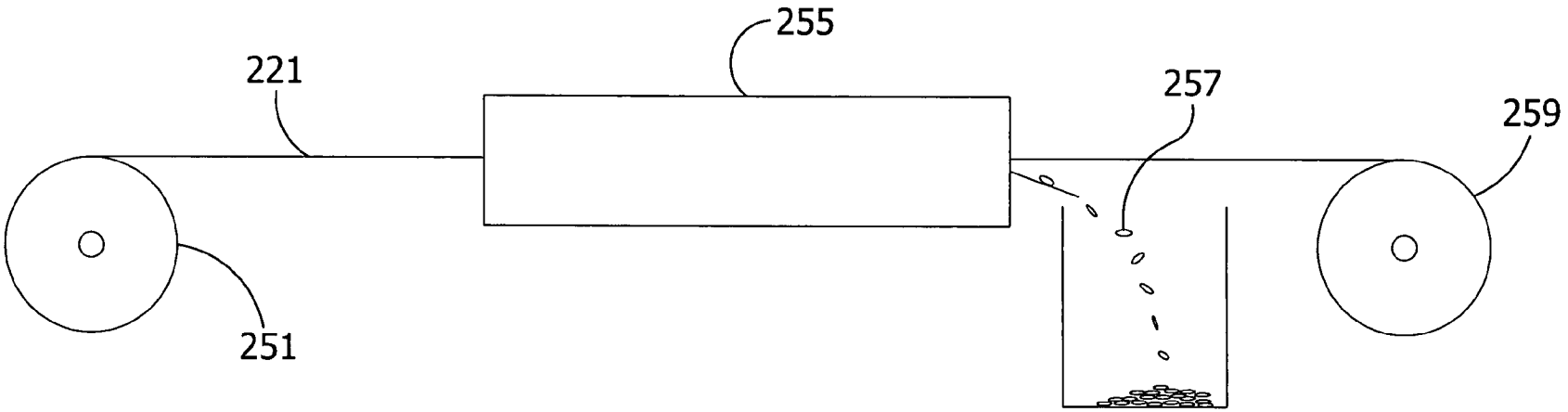
FIG. 11 is a schematic diagram of a process for forming shaving heads from blanks etched in a continuous strip of metal.
Figure 13:
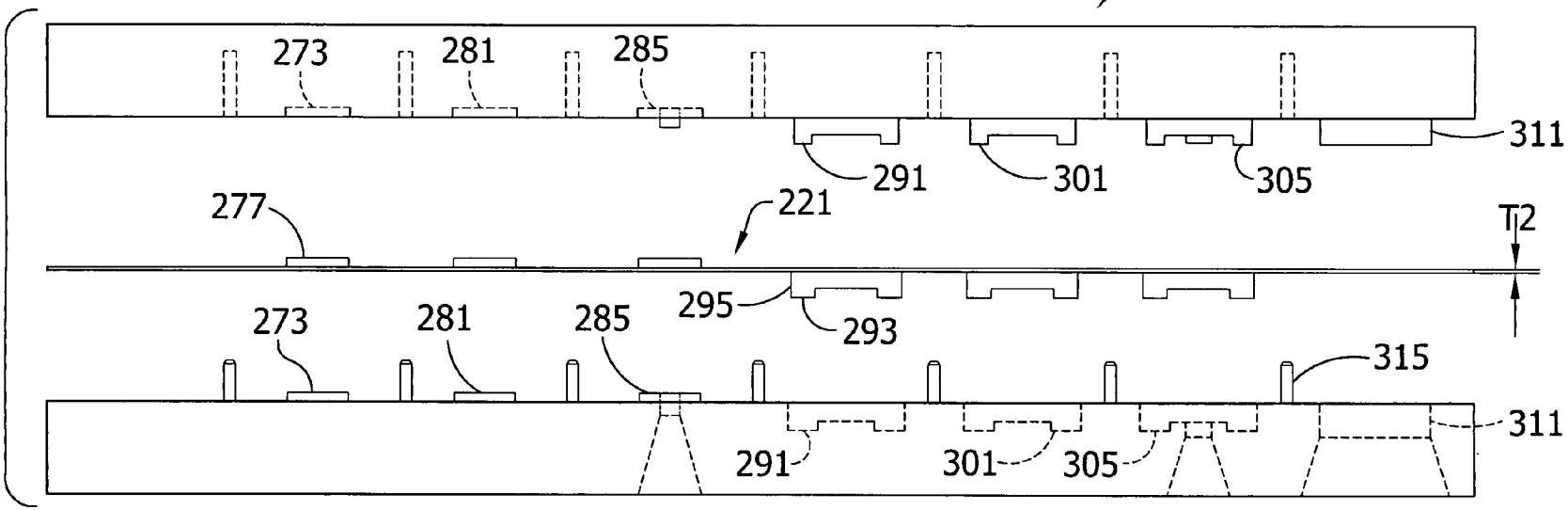

Referring now to FIG. 11, the strip 221 is unwound from the storage roll 251 and fed to an automated forming station 255 (e.g., a progressive die system) that forms the blanks 229 into unfinished cup-shaped shaving heads 257 and severs them from the rest of the strip 221 before it is wound on a waste roll 259. FIG. 13 illustrates one embodiment of an automated forming station 255 having a first set of dies 273 that stamps the blanks 229 to bend the part of the blank that becomes the insert holding portion 277 away from the strip 221 as the strip is fed in the direction of movement of the strip. A second set of dies 281 sets the bend created by the first die 273. A third set of dies 285 cuts an opening 287 (FIG. 12) in the center of the blank 229. A fourth set of dies 291 stamps the strip 221 to bend the part of the blank that becomes the comb portion 293 away from the strip in the opposite direction as the first set of dies 277, thereby forming the cup-shaped configuration (e.g., having the comb portion 293 and sidewall 295) of the unfinished shaving head 257. A fifth set of dies 301 sets the bend created by the fourth set of dies 291. A sixth set of dies 305 trims the opening 287 created by the third set of dies to create the opening 105 for receiving the insert. And the last set of dies 311 severs the formed blank from the strip, including a margin that becomes the flange portion 115 (FIGS. 5 and 6) of the shaving head. The blanks 229 are centered on the die sets 273, 281, 285, 291, 301, 305, 311 by inserting locating pins 315 through the pilot holes 271 etched into the metal strip to ensure proper registration of the blanks on the dies.

Figure 14:
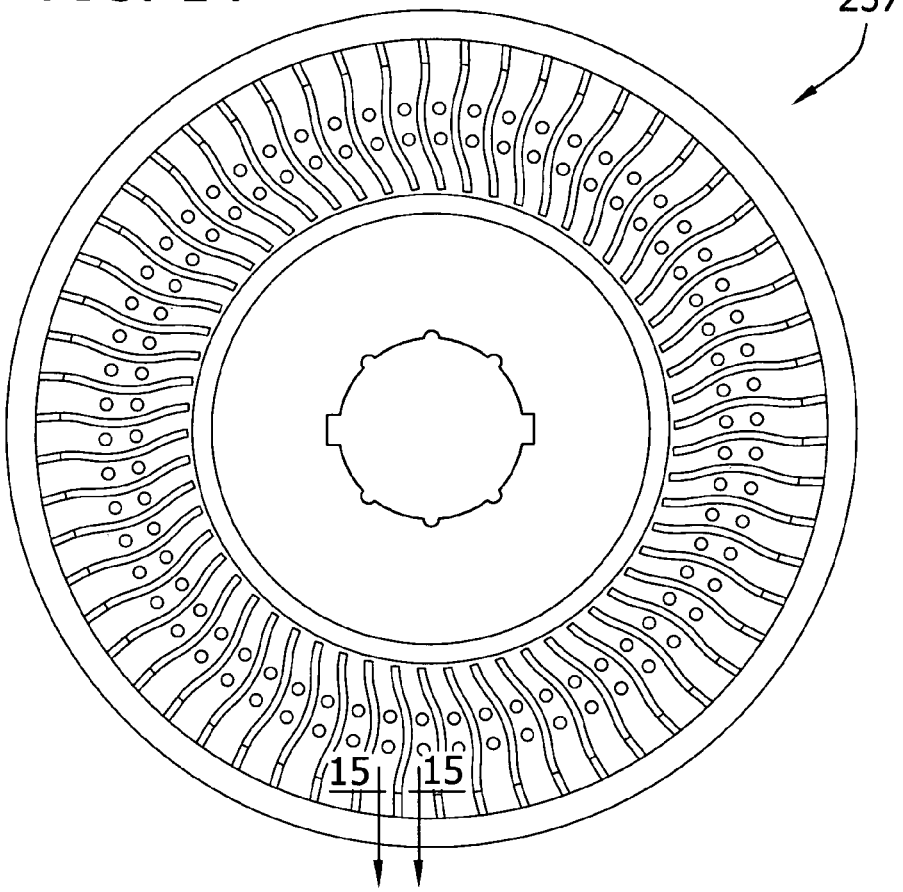
FIG. 14 is a plan view of a rotary shaving head after it has been formed and severed from the continuous strip.
Figure 16:
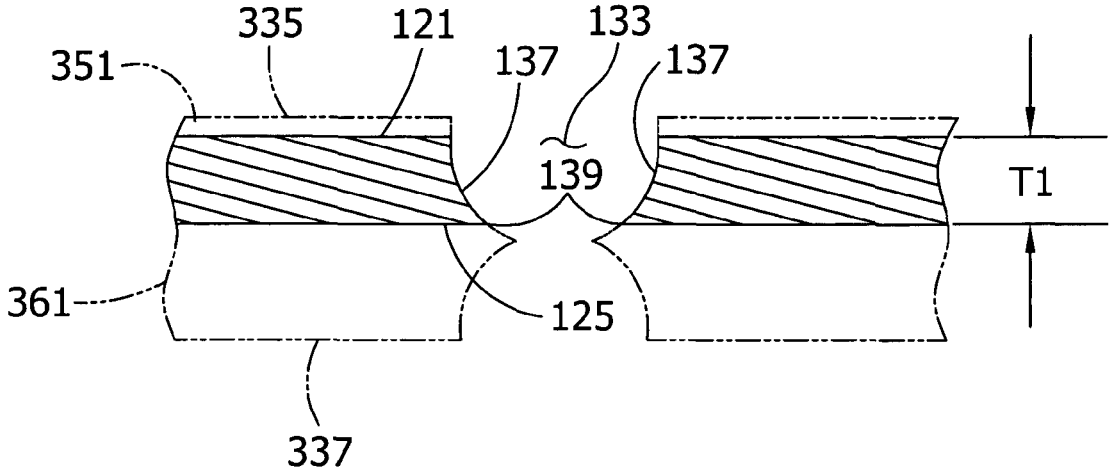
FIG. 16 is an enlarged cross section of the portion of the shaving head shown in FIG. 15 showing how material removed from the shaving head in the grinding process results in the cutting edges having positive rake angles.

FIGS. 14 and 15 illustrate an unfinished shaving head 257 after it has been formed at the forming station 275. The thickness T2 of the comb portion of the shaving head 257 is substantially the same as the initial thickness of the metal strip prior to etching and forming. Moreover, the unfinished shaving head 257 does not yet have positive rake angle cutting edges. The shaving heads 101 are finished by removing material from the unfinished shaving heads 257. More particularly, with reference to FIG. 16, a thin layer of material 35 is ground by a suitable grinding device away from the outer side 335 of the unfinished shaving head 257 to form a generally flat outer surface 121 of the finished shaving head. For example, in one embodiment the layer of material removed to flatten the outer side 335 is between about 0.001 and about 0.002 inches thick. An additional layer 361 of material is removed (e.g., by a suitable grinding device) from the underside 337 of the unfinished shaving head 257 to form the inner surface 125 of the finished shaving head.

The layer 361 removed must be sufficient to provide the desired thickness of the comb portion 109 of the finished shaving head 101 and to form the cutting edges 139 with positive rake angles. For example, material is removed from the underside 337 of the unfinished shaving head 257 to at least the ridges 333 (FIG. 14) formed by the etching process, and more suitably slightly beyond the ridges. As a result, the cutting edges 139 are formed to have positive rake angles. It is understood that the characteristics of the cutting edges 139 and the opening 131 (FIG. 7) can be varied by varying the amount of material removed from the underside 337 of the unfinished shaving head 257. Removing material not only changes the rake angle A1 of the intersection between the inner surface 125 and the opening sidewalls 137 of the finished shaving head 101, it also changes the width W2 of the opening 133 at the inner surface. Accordingly, in one embodiment of the invention, removal of material from the inner surface continues until the comb has the desired thickness, the opening has the desired width W2 at the inner surface and/or the inner surface intersects the openings of the sidewall at the desired angle A1. As an example, the amount of material removed from the underside 337 of the unfinished shaving head 257 is in the range of about 0.004 to about 0.006 inches. After the grinding operation, further conventional finishing (e.g., polishing, coating, and the like) is optionally performed on the shaving head 101.

Figure 17:
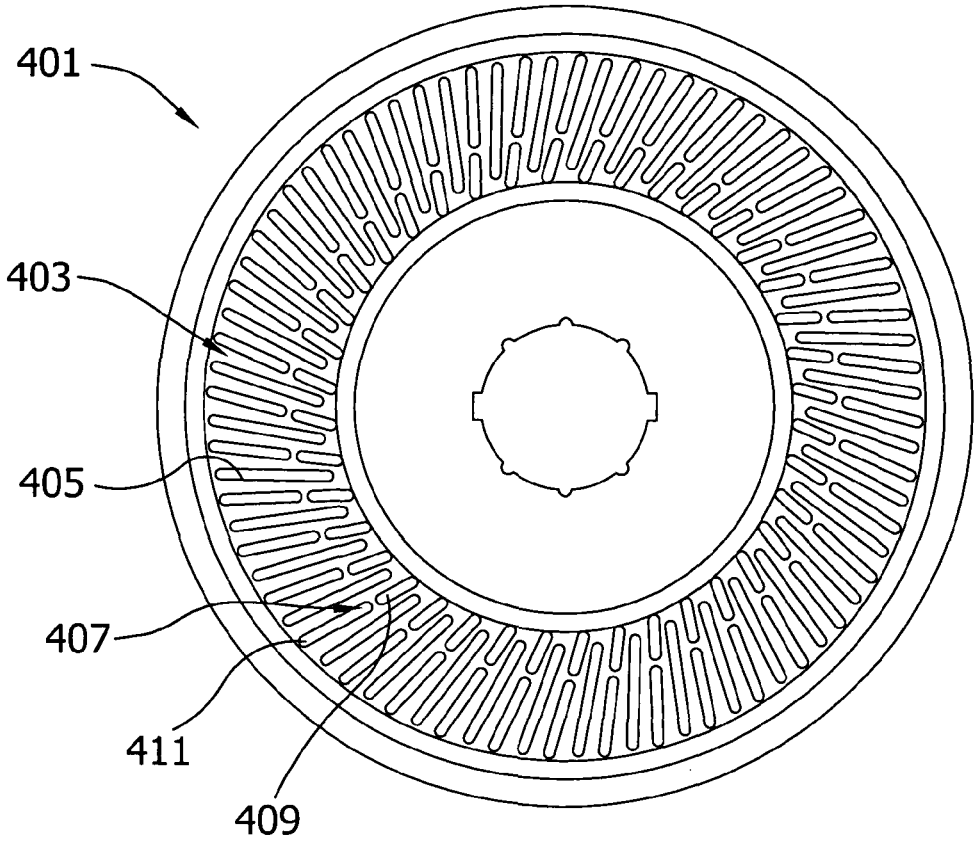
FIG. 17 is a plan view of a second embodiment of a shaving head of the present invention in which the shaving head comprises sets of co-linear openings having different lengths.
Figure 18:
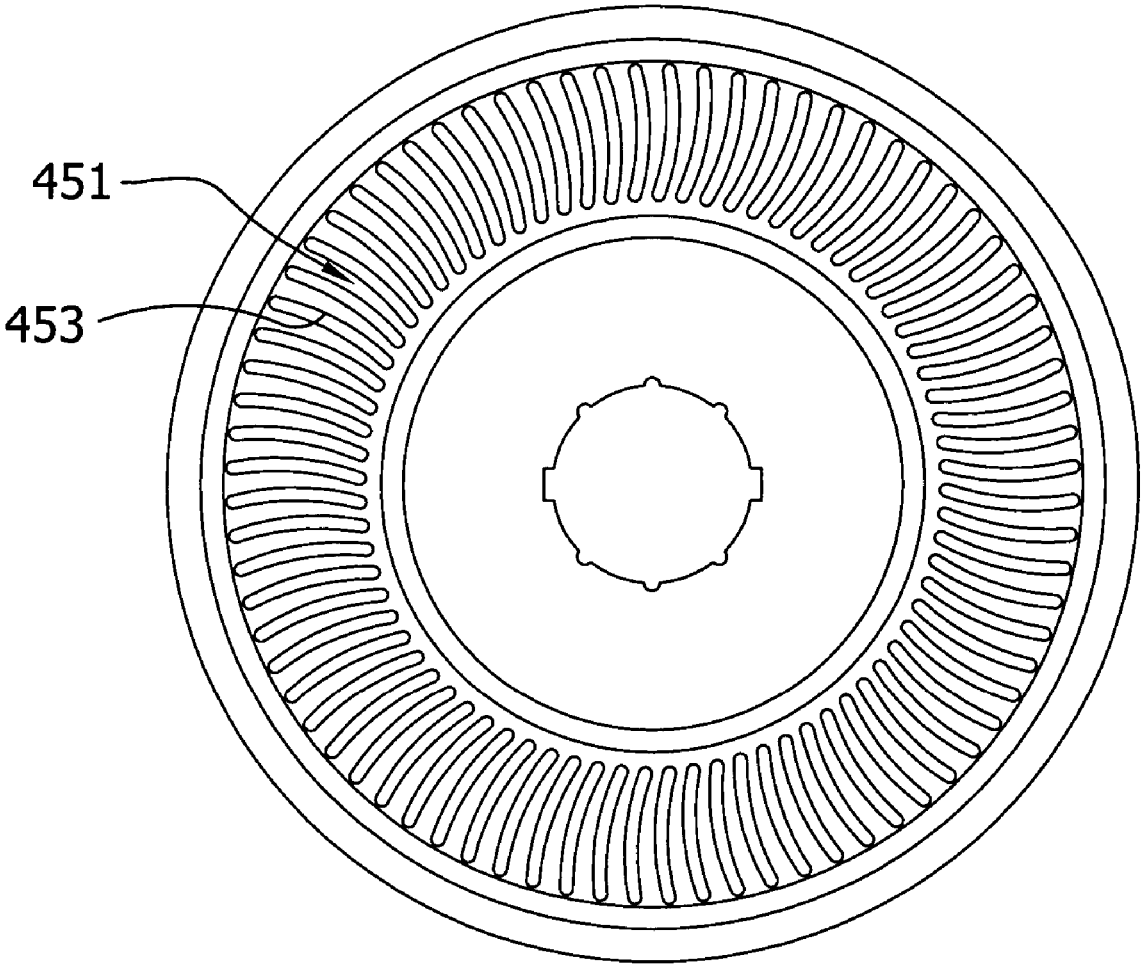
FIG. 18 is a plan view of a third embodiment of a shaving head of the present invention in which the openings in the shaving head comprise curved slots.

It is apparent that a wide variety of shaving heads can be manufactured by the foregoing methods. In particular, the process can be adapted so that the openings 131 in the comb portion 109 of the shaving head 101 have virtually any plan view geometry that is desired. For example, FIG. 17, shows a shaving head 401 in which a set of openings 403 has been chemically etched through the comb portion. The openings comprise a set of long straight slots 405 intersticed by a set of co-linear shorter straight slots 407. One of the co-linear slots 409 is much shorter than the other co-linear slot 411. FIG. 18 shows another shaving head in which a set of openings 451 comprising curved slots 453 has been chemically etched through the comb portion of the shaving head. Openings can also optionally be etched through a portion of the sidewall of the shaving head to facilitate entry of hairs into the shaving head. Referring to FIG. 5, for instance, slots 133 extend through the sidewall 111. Thus, the exemplary shaving heads discussed herein demonstrate the flexibility of the foregoing method for manufacturing shaving heads having openings that have positive rake cutting angles and that have virtually any desired plan view geometries.

Although the embodiment discussed above involves etching a single row of shaving head blanks into a metal strip that is only slightly wider than an individual blank, those skilled in the art will recognize that it is possible to etch multiple rows of shaving head blanks (e.g., four or more rows) into a wider metal strip and then divide the wider metal strip into multiple metal strips so each of the strips has a single row of shaving head blanks etched therein. Then each of the strips can be fed separately into one or more automated forming stations as discussed above without departing from the scope of this invention.

When introducing elements of the invention or the preferred embodiments thereof, the articles "a", "an", "the" and "said" are intended to mean that there are one or more of the elements. The terms "comprising", "including", and "having" are intended to mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

The invention claimed is:

1. A shaving head for a rotary shaver, said shaving head comprising:

a one-piece, generally cup-shaped metal body having an internal cavity for receiving a rotary cutter, a comb portion comprising an outer surface for contacting skin to be shaved and an inner surface in part defining the internal cavity, the comb portion having a plurality of openings therein defined by opposed sidewalls having respective generally arcuate surfaces, the comb portion having a thickness in the range of about 0.0025 inches to about 0.0055 inches, the sidewalls generally curving inward toward each other in a concave manner as the openings extend from the outer surface of the comb portion toward the inner surface thereof, the intersection of at least one sidewall of at least one of said openings with the inner surface of the comb portion of the body defining a cutting edge having a positive rake angle, wherein the shaving head further comprises an annular sidewall depending from the comb portion of said shaving head, the shaving head sidewall having a thickness, the thickness of the comb portion of the shaving head being substantially less than the thickness of said sidewall of said shaving head.

2. The shaving head of claim 1 wherein the openings are chemically etched openings.

3. The shaving head set forth in claim 1 wherein the opposed sidewalls for at least one opening are generally symmetric with each other.

4. The shaving head set forth in claim 1 wherein the opposed sidewalls continuously curve toward each other as the sidewalls extend away from the outer surface of the comb portion.

5. The shaving head set forth in claim 1 wherein the at least one sidewall of said at least one opening has a radius of curvature generally adjacent the cutting edge formed in part by said at least one sidewall of between about 0.004 and about 0.007 inches.

6. The shaving head set forth in claim 5 wherein the radius of curvature is about 0.006 inches.

7. The shaving head set forth in claim 1 wherein said at least one opening has a width at the inner surface of the comb portion in the range of about 0.010 to about 0.011 inches.

8. The shaving head set forth in claim 1 wherein the at least one sidewall of said at least one opening intersects the inner surface of the comb portion at an angle of between about 45 degrees and about 65 degrees.

9. The shaving head set forth in claim 8 wherein said angle is about 55 degrees.

10. The shaving head set forth in claim 1 wherein at least some of the openings are substantially circular.

11. The shaving head set forth in claim 1 wherein the comb portion has a thickness of about 0.003 inches.

* * * * *